United States Patent [19]

Paraskevopoulos

[11] Patent Number: 4,551,004

[45] Date of Patent: Nov. 5, 1985

[54] TONER CONCENTRATION SENSOR

[75] Inventor: Demetris E. Paraskevopoulos, Pittsford, N.Y.

[73] Assignee: Xerox Corporation, Stamford, Conn.

[21] Appl. No.: 644,147

[22] Filed: Aug. 24, 1984

Related U.S. Application Data

[63] Continuation of Ser. No. 198,993, Oct. 21, 1980, abandoned.

[51] Int. Cl.[4] ..... G03G 15/08

[52] U.S. Cl. ..... 355/3 DD; 355/14 D; 118/689; 118/691

[58] Field of Search ..... 355/3 DD, 14 D; 250/559; 222/DIG. 1; 73/DIG. 11; 118/665, 679, 689, 691

[56] References Cited

U.S. PATENT DOCUMENTS

| | | | |
|---|---|---|---|
| 3,233,781 | 2/1966 | Grubbs | 222/57 |
| 3,348,522 | 10/1967 | Donohue | 118/7 |
| 3,376,853 | 4/1968 | Weiler et al. | 118/637 |
| 3,777,173 | 12/1973 | Landrith | 118/691 X |
| 3,873,002 | 3/1975 | Davidson et al. | 222/DIG. 1 |
| 3,876,106 | 4/1975 | Powell | 222/DIG. 1 |
| 4,026,643 | 5/1977 | Bergman | 355/14 D |
| 4,065,031 | 12/1977 | Wiggins et al. | 222/DIG. 1 |
| 4,141,645 | 2/1979 | Reid et al. | 222/DIG. 1 |
| 4,146,325 | 3/1979 | Lange | 355/14 D |
| 4,239,372 | 12/1980 | Iwai | 355/14 D |

*Primary Examiner*—R. L. Moses

*Attorney, Agent, or Firm*—Ronald F. Chapuran

[57] ABSTRACT

The present invention is an apparatus for monitoring toner concentration on a photoreceptor surface. The apparatus includes a light emitting diode, the phototransistor, a beam splitter, and a lens disposed between the beam splitter and the photoreceptor surface to collimate the light beam between the lens and the photoreceptor surface. A portion of the light emitted from the LED is transmitted through the beam splitter and the lens to the photoreceptor surface. Collimated light is reflected from the photoreceptor surface back through the lens and reflected from the beam splitter to the phototransistor. The output signal from the phototransistor because of the incident and reflected collimated light is independent of the distance of the lens from the photoreceptor surface. Alternately, a second lens is disposed between the beam splitter and the phototransistor to enhance overall resolution.

9 Claims, 3 Drawing Figures

TONER CONCENTRATION SENSOR

This is a continuation of application Ser. No. 198,993 filed Oct. 21, 1980, now abandoned.

This invention relates to the monitoring of electrostatic image development and, in particular, to an image development sensor for determining the concentration of toner on a photoreceptor surface by optically sensing the amount of toner that is triboelectrically attracted to a portion of the photoreceptor surface.

In accordance with well known electrostatic printing processes, a surface bearing a latent electrostatic image is developed by selectively applying a developer mix comprising toner and a carrier medium to the image. With repeated use of the developer mix, toner is gradually consumed until there is no longer a sufficient concentration of toner in the mix to develop high quality, dense images. Also, the toner concentration may be insufficient due to an unsuitable electrical bias on the developing system.

The prior art systems of monitoring toner concentration generally follow two schemes of measurement, electrical and optical. Electrical systems depend upon measurements such as measuring the changes in resistance in the mix as the high resistivity toner component varies in relation to the conductive carrier component or measuring the change in inductance in a coil through which the carrier and toner components are conveyed. In the optical systems, a test pattern is established either in the developer housing or on the photoreceptive surface itself. The concentration of toner in the mix is then correlated to the toner concentration as determined by an optical sensing device measuring the amount of toner on the test pattern.

For example, prior art systems such as disclosed in U.S. Pat. Nos. 3,348,522; 3,348,523 and 3,376,853 disclose a reflective type sensor. In particular, a clean drum signal is compared to a signal reflected from a test pattern formed on the drum. Separate sensors are used for detecting each signal and the outputs of the sensors are compared by a bridge circuit to provide an error signal. The error signal represents the degree of toner concentration.

In systems as shown in U.S. Pat. Nos. 3,873,002 and 4,065,031, an electrically biased transparent electrode disposed on the photoreceptor surface is conveyed past the development station to attract toner particles. Light is transmitted from within the photoreceptor surface through the transparent electrode and detected by a photosensor surface. The photosensor provides a signal indicative of the density of toner particles on the transparent electrode. A disadvantage with systems of this type is the relative cost due to the complexity and number of components required.

Other systems measure toner concentration in the developer mixture contained in a developer housing or resevoir. For example, U.S. Pat. Nos. 3,233,781 and 3,876,106 disclose reflecting a light beam from the developer mixture. The measure of the reflectivity of the mixture manifests the proportion of the toner to carrier concentration in the mixture. Disadvantages with systems of this type are due in part to noise generated in the system, due to the fact that the system is only an analog of the amount of toner actually applied to the photoreceptor surface, and independent of the effects of photoreceptor bias and exposure intensity, and due to the dependence of the system to the constituents of the developer mixture.

Other examples of analog control are U.S. Pat. No. 3,968,926 teaching the use of a funnel in the developer apparatus to collect developing material. An inductance coil is wound about the funnel and connected to a bridge circuit. The reactance of the inductance coil varies in accordance to percentage of toner contained in the developing material.

A difficulty with many of the above mentioned toner monitoring systems is that the accuracy of the systems depends upon a well controlled distance between the measuring instrument and the photoreceptor surface. In other words, the output of the sensing devices can vary considerably as the distance between the sensing device and the photoreceptor surface varies. This is particularly true in xerographic reproduction machines using belt photoreceptors rather than drum photoreceptors. Except for locations very near the drive rolls, the position of a belt in a belt system will vary during use. In particular, the flutter and ripple of the belt, dynamic oscillations, and localized deformations induced in the coating process can cause the distance between the belt and the sensor to vary. Since the toner sensor voltage fluctuations due to a photoreceptor spacing and misalignment are indistinguishable from those due to different developed toner masses, a device that is insensitive to these variables is very advantageous.

It would be desirable therefore, to provide a simple inexpensive densitometer or toner sensor for use in a xerographic processing machine that provides a stable output signal for varying distances from the densitometer to the surface under test.

It is therefore an object for the present invention to obtain improved toner concentration sensing by using a toner concentration sensor providing a relatively constant output signal regardless of the distance between the sensor and the photoreceptor surface.

Further advantages of the present invention will become apparent as the following description proceeds, and the features characterizing the invention will be characterized with particularity in the claims annexed to and forming a part of this specification.

Briefly, the present invention is concerned with apparatus for monitoring toner concentration on a photoreceptor surface. The apparatus includes a light emitting diode (LED), the phototransistor, a beam splitter, and a lens disposed between the beam splitter and the photoreceptor surface to collimate the light beam between the lens and the photoreceptor surface. A portion of the light emitted from the LED is transmitted through the beam splitter and the lens to the photoreceptor surface. Collimated light is reflected from the photoreceptor surface back through the lens and reflected from the beam splitter to the phototransistor. The output signal from the phototransistor, because of the reflected collimated light beam, is not dependent upon the distance of the lens to the photoreceptor surface. Alternately, a second lens is disposed between the beam splitter and the phototransistor to enhance the overall resolution of the system.

For a better understanding of the present invention, reference may be had to the accompanying drawings wherein the same reference numerals have been applied to like parts and wherein.

Figure 1:
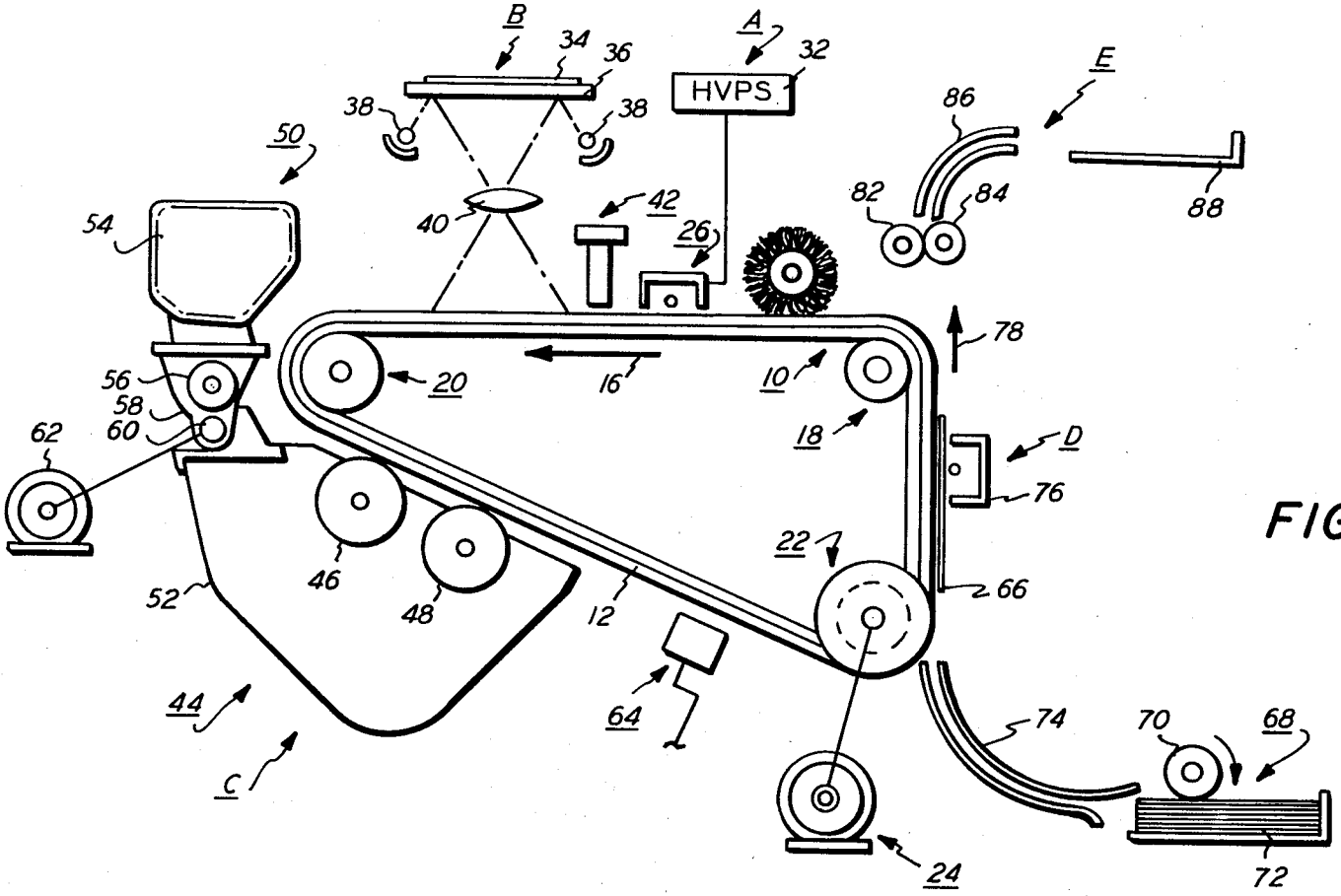
FIG. 1 is a schematic elevational view of an electrophotographic printing machine incorporating the features of the present invention.

With reference to FIG. 1, there is illustrated an electrophotographic printing machine having a belt 10 with a photoconductive surface 12 moving in the direction of arrow 16 to advance the photoconductive surface 12 sequentially through various processing stations. At charging station A, a corona generating device 26 electrically connected to high voltage power supply 32 charges the photoconductor surface 12 to a relatively high substantially uniform potential. Next, the charged portion of the photoconductive surface 12 is advanced through exposure station B. At exposure station B, an original document 34 is positioned upon a transparent platen 36. Lamps 38 illuminate the original document and the light rays reflected from the original document 34 are transmitted through lens 40 onto photoconductive surface 12. The exposure station B also includes test area generator 42 comprising a light source providing two different output levels. The two different output levels provide different intensity test light images projected onto the photoconductive surface 12 to record two test areas. Each of the test area recorded on the photoconductive surface 12 is rectangular and about 10 mm by 8 mm in size. Each of these test areas will be developed with toner particles at development station C.

A magnetic brush development system 44 advances a developer material into contact with the electrostatic latent image in the test areas at development station C. Preferably, the magnetic brush development system 44 includes two magnetic brush developer rollers 46 and 48. Each developer roller forms a brush comprising carrier granules and toner particles. The latent image and test areas attract toner particles from the carrier granules forming a toner powder image on the latent image and a pair of developed mass areas corresponding to each of the test areas.

A toner particle dispenser 50 is arranged to furnish additional toner particles to housing 52. In particular, a foam roller 56 disposed in a sump 58 dispenses toner particles into an auger 60 comprising a helical spring mounted in a tube having a plurality of apertures. Motor 62 rotates the helical member of the auger to advance the toner particles to the housing 52. The developed test areas pass beneath a collimated infrared densitometer or toner sensor 64. The infrared densitometer 64 is positioned adjacent the photoconductor surface 12 between the developer station C and transfer station D and generates electrical signals proportional to the developed toner mass of the test areas.

At the transfer station D, a sheet of support material 66 is moved into contact with the toner powder image. The sheet of support material is advanced to the transfer station by sheet feeding apparatus 68, preferably including a feed roll 70 contacting the uppermost sheet of stack 72. Feed roll 70 rotates so as to advance the uppermost sheet from stack 72 into chute 74. The chute 74 directs the advancing sheet of support material into contact with the photoconductive surface 12 in timed sequence in order that the toner powder image developed thereon contacts the advancing sheet of support material at the transfer station.

Transfer station D includes a corona generating device 76 for spraying ions onto the underside of sheet 66. This attracts the toner powder image from photoconductive surface 12 to sheet 66. After transfer, the sheet continues to move onto a conveyor (not shown) which advances the sheet to fusing station E.

Fusing station E includes a fuser assembly 80 for permanently affixing the transferred powder image to sheet 66. Preferably, the fuser assembly comprises a heated fuser roller 82 and a backup roller 84. The sheet 66 passes between the fuser rollers with the toner powder image contacting fuser roller 82. After fusing, the chute 86 drives the advancing sheet 66 to catch tray 88 for removal from the printing machine by the operator.

Figure 2:
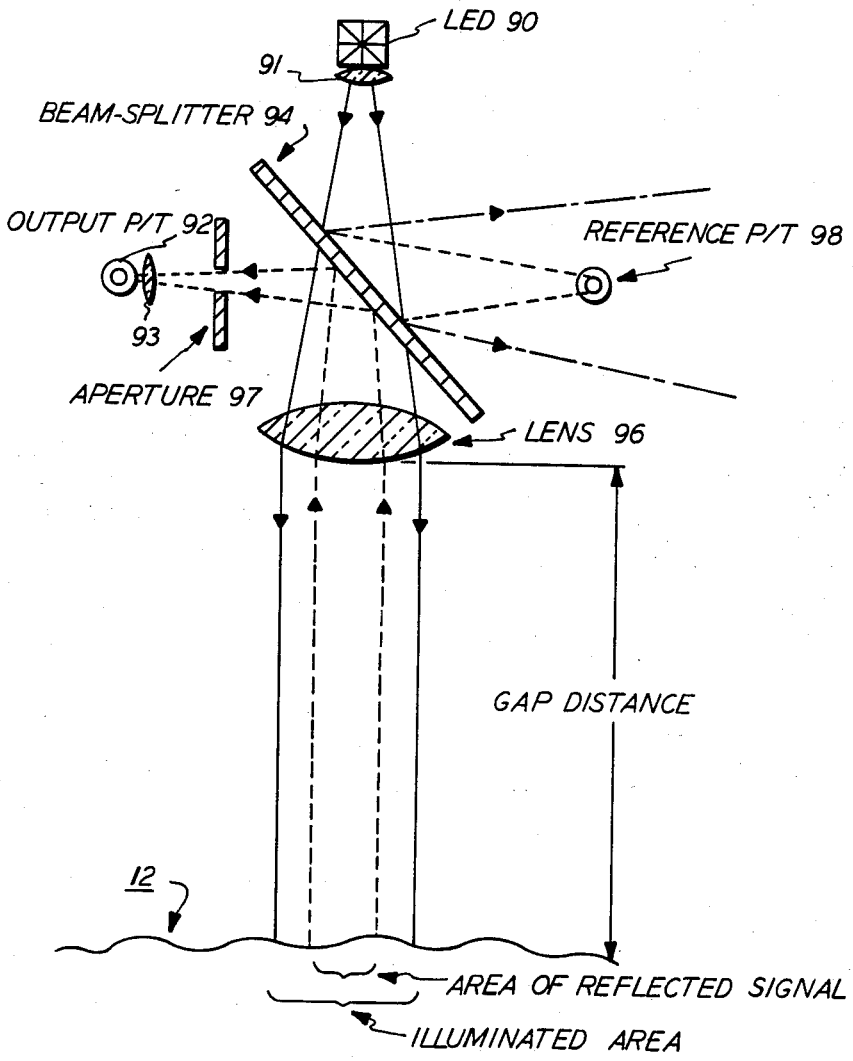
FIG. 2 is a collimated infrared densitometer or toner sensor in accordance with the present invention.

In accordance with the present invention, the infrared densitometer 64 as shown in FIG. 2 includes a suitable semiconductor light emitting diode (LED) 90, a phototransistor 92, a beam splitter 94 and a double convex lens 96. The LED 90 can provide, for example, a 940 nanometer peak output wavelength with a 60 nanometer one-half power bandwidth. In a preferred embodiment, the power output is approximately 45 $\pm 10$ milliwatts. The phototransistor 92 receives the light rays or beam reflected from the test areas on the photoconductive surface 12 of belt 10. The phototransistor 92 converts the light ray input to an electrical output signal ranging from about zero volts to about ten volts. The LED 90 and phototransistor 92 can be provided with focusing lenses 91 and 93, respectively.

The infrared densitometer 64 is also used periodically to measure the light rays reflected from the bare photoconductive surface, i.e. without developed toner particles, to provide a reference level for calculation of the signal ratios. Preferably, a not shown air purge system is associated with the infrared densitometer to prevent the accumulation of particles on the optic components.

As illustrated in FIG. 2 by the solid lines, a collimated light beam is projected from the lens 96 to the portion of the photoconductive surface 12 illustrated as the illuminated area. Preferably, the photoconductive surface 12 provides a considerable amount of specular reflectance. It should be noted, however, that a surface that is substantially diffuse reflecting will work, but may diminish the accuracy of the densitometer 64.

A collimated light beam as shown by the dotted lines is reflected from the surface 12 back to lens 96. There is a relatively large area of surface 12 reflecting light, illustrated as the area of reflected signal. The reflected light signal or beam is also collimated between the surface 12 and lens 96. Thus, the illumination and reflected beams remain relatively constant, regardless of the gap distace between the lens 96 and the surface 12. This relatively constant reflected beam is projected onto the phototransistor 92. In other words, the output signal from phototransistor 92 is relatively constant regardless of gap distance.

In operation, the light output or beam from the light emitting diode 90 is projected through the beam splitter 94. Preferably, the beam splitter 94 is 50 percent transmissive and is positioned to enable both the phototransistor 92 and the LED 90 to be located on the same optical axis. The light beam transmitted to the beam splitter 94 is then projected through the lens 96 onto the photoreceptive surface 12. In a preferred embodiment, the lens 96 is an 18 mm focal bi-convex lens. The lens 96 provides collimation of the light beam onto the photoreceptor surface 12 and focuses the spectrally reflected portion of the beam onto the phototransistor 92 through a suitable aperture 97.

Preferably, this arrangement allows approximately 50 percent of the energy specularly reflected from the photoreceptive surface 12 to be collected and focused onto the phototransistor 92 independent of the lens 96 to photoreceptor surface 12 distance. A second phototransistor 98 can be placed in the path of the light beam initially reflected from the beam splitter 94 as shown in FIG. 2. This will provide a reference signal to compensate for light output changes due to LED aging and ambient temperature changes.

Figure 3:
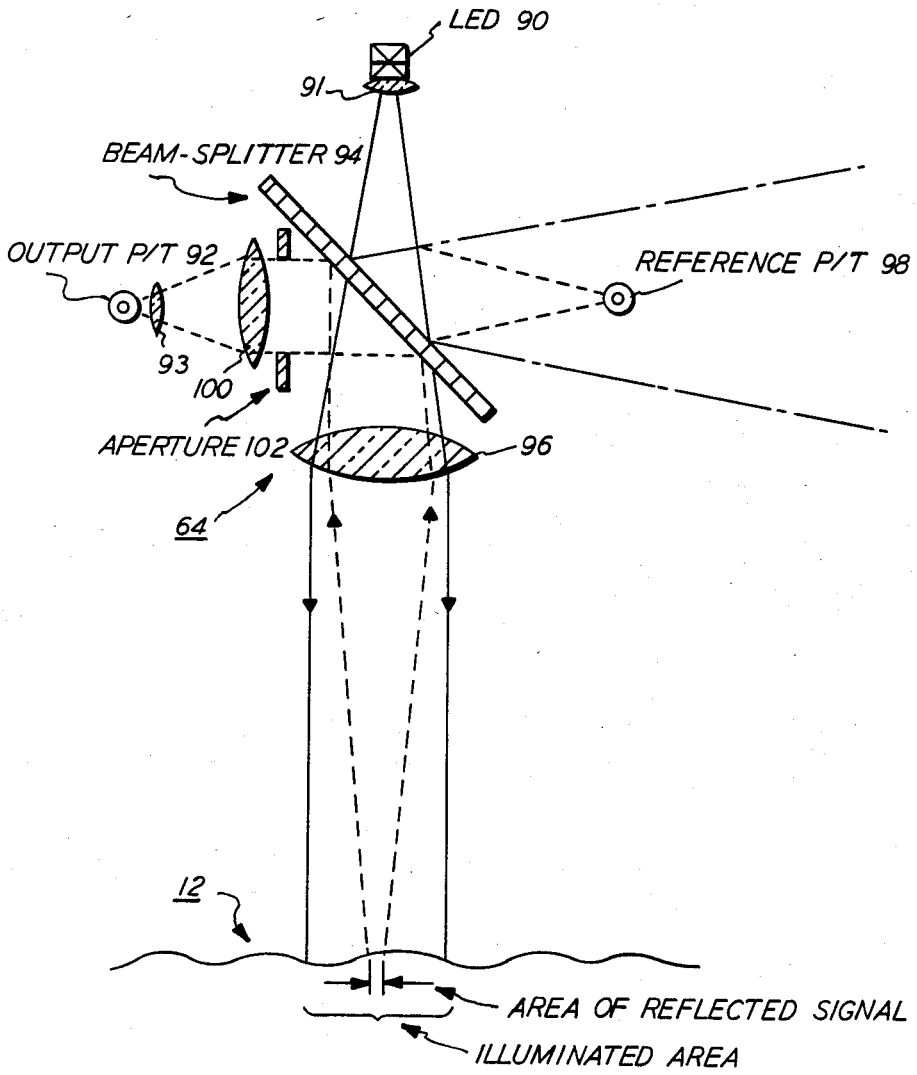
FIG. 3 is an infrared line densitometer in accordance with another feature of the present invention.

In accordance with another feature of the present invention, a double convex lens 100 may be inserted between the phototransistor 92 and the beam splitter 94 or between beam splitter 94 and LED 90 to enhance the overall resolution of the sensor as shown in FIG. 3. The resolution is approximately inversly proportional to the total system magnification of the lenses. For typical values, in a preferred embodiment, the expectant resolution is of the order of 40 micrometers.

It should be noted that the focal length of lens 100 is determined by the average operating gap distance between lens 96 and photoconductive surface 12 in order to minimize lens errors. In operation, the effect of lens 100 is to diminish the collimation of the beam reflected from surface 12 in favor of better resolution.

The effect of lens 100 is illustrated in FIG. 3, showing in dotted lines an exaggerated diverging beam reflected from a relatively small area of surface 12. Thus, the resolution is enhanced, illustrated by the relatively small area of reflected signal, at the expense of a less collimated reflected signal. An aperture 102 can be included to minimize error in spot size due to lens errors.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. Apparatus for monitoring toner concentration including a. a light emitting diode (LED)

b. a first phototransistor, c. a photoreceptor surface, d. a beam splitter in communication with the LED and the phototransistor, e. a first lens disposed between the beam splitter and the photoreceptor surface for collimating the light from the LED, a portion of the light from the LED transmitted through the beam splitter and the lens to the photoreceptor surface, a portion of the collimated light reflected from the photoreceptor surface being transmitted back through the first lens and reflected from the beam splitter to the phototransistor to compensate for variable distance between the first lens and the photoreceptor surface.

2. The apparatus of claim 1 wherein the LED and the phototransistor are located approximately at the focal point of the lens.

3. The apparatus of claim 1 including a second phototransistor in the path of the LED light beam immediately reflected from the beam splitter to provide a reference signal to compensate for LED light output changes.

4. The apparatus of claim 1 including a second lens disposed between the beam splitter and the phototransistor to enhance resolution.

5. An electrophotographic reproduction machine including a photoreceptor surface, an optical system for projecting images of objects onto the photoreceptor surface, a developer for applying toner particles to the latent image on the photoreceptor surface and an optical densitometer for monitoring toner density on a portion of the photoreceptor surface, the optical densitometer comprising a light emitting diode (LED), a beam splitter, a lens, a portion of the light from the LED being transmitted through the beam splitter and the lens to the photoreceptor surface, a phototransistor, a portion of the light transmitted from the LED to the photoreceptor surface through the beam splitter and the lens being reflected from the photoreceptor surface back through the lens to the beam splitter, and reflected from the beam splitter to the phototransistor whereby a signal is provided representative of the concentration of toner on the photoreceptor surface, the signal being independent of the distance from the lens to the photoreceptor surface.

6. An electrophotographic reproduction machine including a photoreceptor surface, an optical system for projecting images of objects onto the photoreceptor surface, a developer for applying toner particles to the latent image on the photoreceptor surface and an optical densitometer for monitoring toner density on a portion of the photoreceptor surface, the optical densitometer comprising a light emitting diode (LED), a beam splitter, a first lens for collimating the light from the LED, a portion of the light from the LED being transmitted through the beam splitter and the lens to the photoreceptor surface, a second lens, a phototransistor, a portion of the light transmitted from the LED to the photoreceptor surface through the beam splitter and the first lens being reflected from the photoreceptor surface back through the first lens to the beam splitter, and reflected from the beam splitter through the second lens to the phototransistor whereby a signal is provided representative of the concentration of toner on the photoreceptive surface, the signal being independent of the distance from the lens to the photoreceptor surface.

7. Apparatus for monitoring toner concentration on a photoreceptor surface independent of the apparatus to surface distance including a. a light source, b. a photoconductor for providing a signal, and c. a lens disposed between the light source and the photoreceptor surface for collimating the light from the light source, a portion of the light from the light source being transmitted through the lens to the photoreceptor surface along a light path, a portion of light being reflected from said photoreceptor surface back to the lens along said light path, the photoconductor receiving the light being reflected whereby the signal is independent of the apparatus to surface distance.

8. Apparatus for monitoring toner concentration on a photoreceptor surface including a. a light source, b. a first photoconductor, c. a photoreceptor surface, and d. a first lens disposed between the light source and the photoreceptor surface, a second lens disposed between the first lens and the photoconductor, a portion of the light from the light source transmitted through the first lens to the photoreceptor surface along a light path, a portion of the light being reflected back from the photoreceptor surface to the first lens along said light path, said last mentioned portion of the light further being transmitted through the second lens to the photoconductor.

9. The apparatus of claim 8 including a second photoconductor in the path of the light source to provide a reference signal to compensate for light output changes.

* * * * *